US005476214A

United States Patent [19]

Fisk, Jr.

[11] Patent Number: 5,476,214

[45] Date of Patent: Dec. 19, 1995

[54] PIZZA BOX WITH WEDGE-SHAPED BREAK-DOWN SPATULA-PLATES

[76] Inventor: James Fisk, Jr., P.O. Box 2068, Kodiak, Ak. 99615

[21] Appl. No.: 345,924

[22] Filed: Nov. 28, 1994

[51] Int. Cl.[6] ..... B65D 5/42

[52] U.S. Cl. ..... 229/103; 229/107; 229/906

[58] Field of Search ..... 229/103, 107, 229/114, 902, 906; 206/551; 426/115

[56] References Cited

U.S. PATENT DOCUMENTS

| | | | |
|---|---|---|---|
| 798,264 | 8/1905 | Carrier | 229/907 |
| 2,162,089 | 6/1939 | Kagen | 229/906 |
| 3,037,682 | 6/1962 | Daubert | 229/103 |
| 4,326,356 | 4/1982 | Mason | 229/103 |
| 4,648,548 | 3/1987 | Skin | 229/103 |
| 4,746,010 | 5/1988 | Fournier | 229/10 |
| 5,014,853 | 5/1991 | Crockett | 229/103 |
| 5,052,559 | 10/1991 | Bressi, Jr. | 729/906 |
| 5,098,013 | 3/1992 | France et al. | 229/906 |
| 5,110,038 | 5/1992 | Pantisano et al. | 229/103 |
| 5,180,075 | 1/1993 | Montalbano | 229/906 |

*Primary Examiner*—Gary E. Elkins
*Attorney, Agent, or Firm*—Michael J. Tavella

[57] ABSTRACT

The present design is pizza box top that has a number of spatula-type trapezoidal shaped plates. These plates can be separated from the box and then used to lift out individual slices of pizza. The plates have a sharp point that cuts easily through the cheese in the center of the pizza. A pizza slice, resting on the plate can be picked up cleanly and safely, ready to eat. The number and size of the plates varies depending on the size of the pizza box i.e., small, medium or large. A second design uses a box insert that has the plates cut into it. This insert can then be placed into the lids of existing pizza boxes. In this way, the millions of pizza boxes already in inventory can be used without having to waste or modify them. The inserts, like the boxes are sized to fit into appropriate pizza boxes. A third design is used for supermarket pizzas that use a circular cardboard base. The standard base can be replaced with a circular base using the spatula-plates.

16 Claims, 4 Drawing Sheets

PIZZA BOX WITH WEDGE-SHAPED BREAK-DOWN SPATULA-PLATES

This invention relates to improvements in Pizza boxes and more particularly to Pizza boxes having perforated plates section formed therein.

BACKGROUND OF THE INVENTION

The pizza business has grown to become a major segment of the retail food market with sales of $6 billion. It is estimated that 95 percent of Americans eat pizza. There are over 58,000 pizza parlors in the United States. While Pizza is eaten in restaurants, its biggest sales are in the take-out market. Millions of pizza take-out and delivery boxes are consumed every day. The basic pizza box is just that-a square or rectangular box. Some companies use round boxes and some use insulated boxes. The basic pizza box, however, is made out of fiberboard.

Today's pizzas are made with a lot of cheese. This cheese frequently forms a large mass in the center of the pizza. Since many pizzas are almost never cut clean through, this mass of cheese causes the slices to stick together. When trying to remove a slice of pizza from a box that has slices stuck together, removing a slice can be difficult. Pulling the slice of pizza from the box causes this cheese to stretch, leaving the mass of cheese in the box. Because this cheese is often hot, it may be dangerous for small children who may be burned trying to remove this cheese. Adults also have problems with this cheese, often pulling cheese off the slice of pizza.

Several types of pizza box improvements have been patented. Mostly, these improvements fall into two groups. First is the type that attempts to eliminate the sticking cheese problem by providing a segmented box. The second group does not address this problem in particular. Rather these patents describe segmented plates that can be formed in the box and used to eat the pizza.

An example of the first group is U.S. Pat. No. 3,771,713 to Davidson. This patent forms a tray for pie shaped objects. It has a number of segments that the cut pieces can be placed. Although use of a tray as taught by Davidson solves the problem of the coagulation of cheese, it has another problem in itself. It simply takes too much time for the pizzeria to individually place separate pizza slices in such a box.

Examples of the second group are found in U.S. Pat. Nos. 3,335,846 to Mills, 5,014,853 to Crockett, and 5,110,038 to Pantisano et al. Mills teaches an insulated pizza box that is circular. The top is segmented into a number of pie shaped sections that come together in the center with a center vent hole. These sections can be broken out to form individual holders for the pizza. Note that because of the curved tip of these plates, and the thickness of the insulation, they cannot easily be used to lift the slices of pizza from the box.

Crockett teaches a pizza box that has a perforated top. In this design, the box top can be separated into four square plates. Each plate has a thumb hole in the box edge that can be used to lift the plate. Pantisano teaches a box with a perforated lid and a perforated bottom. Both the lid and the bottom can be broken out to form plates. The bottom provides square plates and the top is cut for round plates. All of these designs suffer from the same problem: none can be used to lift a slice of pizza from a box in such a manner as to quickly cut the coagulated cheese in the center of the pizza to enable a single slice to be removed without pulling half the cheese from the pizza.

SUMMARY OF THE INVENTION

The present invention overcomes these difficulties. It provides a pizza box top that has a number of spatula-plates. These spatula-plates can be separated from the box and then used to lift out individual slices of pizza. The spatula-plates have a sharp point that cuts easily through the cheese in the center of the pizza. A pizza slice resting on the plate can be picked up cleanly and safely, ready to eat. The number and size of the plates varies depending on the size of the pizza box, i.e., small, medium or large.

A second embodiment of the invention uses a box insert that has the plates cut into it. This insert can then be placed into the lids of existing pizza boxes. In this way, the millions of pizza boxes already in inventory can be used without having to waste or modify them. The inserts, like the boxes are sized to fit into appropriate pizza boxes.

A third embodiment replaces the standard circular cardboard bases used for supermarket pizzas with a circular base that has spatula-plates.

The spatula-plates can be kept after the first use to be used for reheating pizza in microwave ovens. The spatula-plates have two advantages over ordinary dishes. First, they eliminate the need to clean the dish after use. Second, the cardboard material provides excellent insulation to speed up the reheating process.

DETAILED DESCRIPTION OF THE INVENTION

Figure 8:
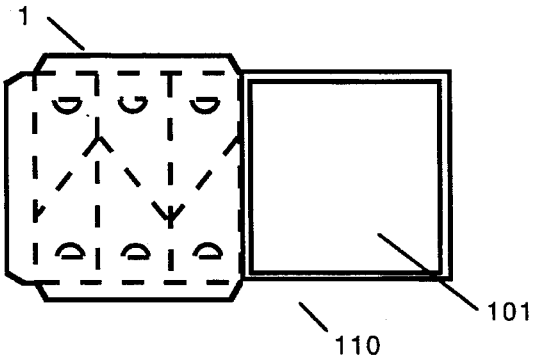
FIG. 8 is a top view of an entire pizza box, with the top portion being an embodiment of the instant invention.
Figure 9:
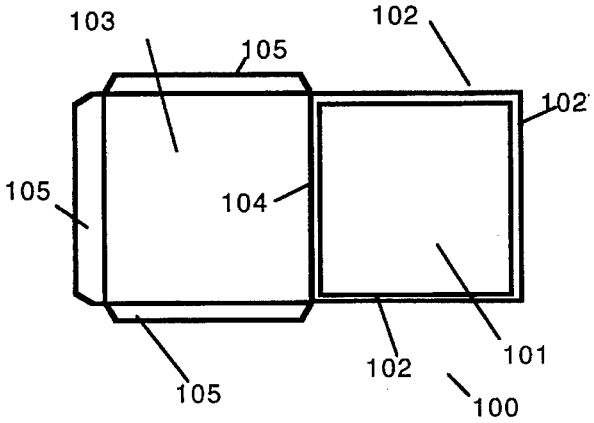
FIG. 9 is a top view of a conventional pizza box.

Referring now to the drawings, and particularly FIGS. 8 and 9, FIG. 9 shows a conventional pizza box 100. The typical conventional pizza box 100 has a square bottom portion 101, which has four side walls 102 that extend upward forming a walled tray that can support a pizza. A top 103 is attached to the bottom portion 101 at edge 104. The edge 104 is designed to act as a hinge that allows the top of the box 103 to open and close. FIG. 9 shows the conventional pizza box 100 in the open position. The top 103 of the conventional pizza box 100 has three flaps 105. These flaps can be secured to the side walls 102 of the bottom portion 101, thereby sealing the pizza box 100 for carrying the pizza.

FIG. 8 shows a pizza box 110 that uses the instant invention. This pizza box 110 has a bottom portion 111 that is identical to the bottom portion 101 of a conventional pizza box 100. The pizza box 110 of FIG. 8 is shown using the first embodiment 1 of the invention (see FIG. 1). Because all the pizza boxes described below use a bottom portion 101 that is identical to the conventional pizza box bottom portion 101, no further explanation of the bottom portion is included in the discussion of the different embodiments. In every embodiment discussed below, a pizza box bottom portion 101 is attached by a perforated edge so that it can be readily removed.

Figure 1:
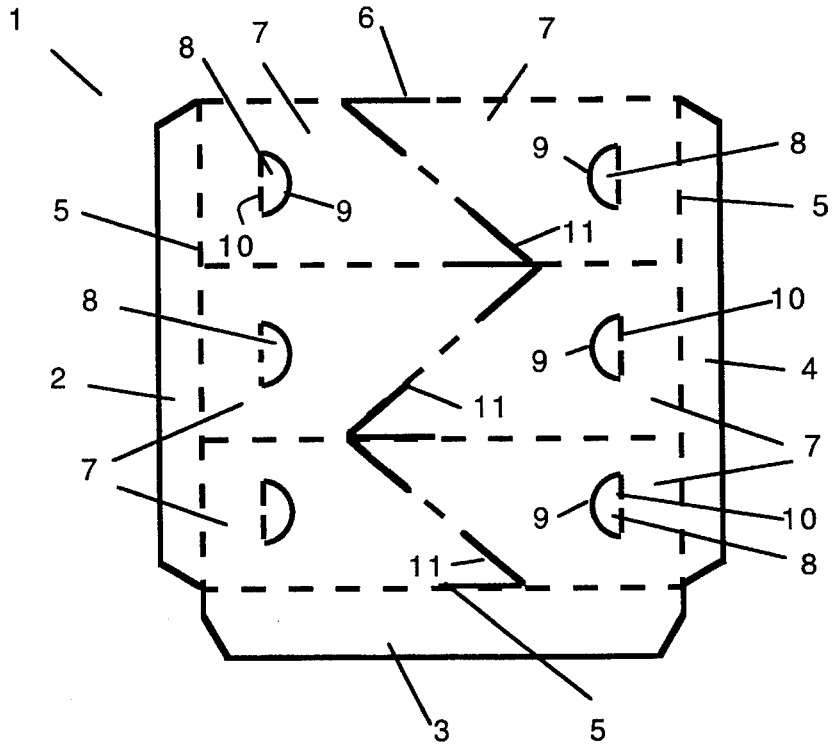
FIG. 1 is a top view of a large pizza box showing the invention.

Referring now to FIGS. 1 through 7, several embodiments of the invention are shown. These embodiments cover different sizes and shapes of pizza boxes. Notwithstanding these differences, the embodiments all have similar characteristics. FIG. 1 is illustrative of the common characteristics. FIG. 1 shows a pizza box top 1 it has three end flaps 2, 3, and 4. The end flaps are attached to the lid with perforations 5 so they can be easily removed. The top edge of the lid 1 is perforated so that the entire pizza box top 1 can be removed from the box. The pizza box top 1 is broken up into a number of trapezoidal sections 7, which make up the pizza serving spatula-plates. The plates 7 are all perforated for easy removal from the pizza box top 1. Note that the tips 11 of the spatula-plates 7 in all designs are pre-cut. This makes removing the spatula-plates 7 easier.

Each spatula segment forms a trapezoid. This shape is preferred because it has a large square base that can support a piece of pizza without being the same shape as the slice. This makes holding the spatula/plate 7 easier and safer. The top portion of the spatula/plate 7 forms a point, which can then be used to cleanly lift a slice of pizza from the box, completely separating the slice from the remainder of the pizza and cutting through any coagulated clumps of cheese found in the center. The design for the typical large pizza box has six spatula-plates 7.

Figure 10:
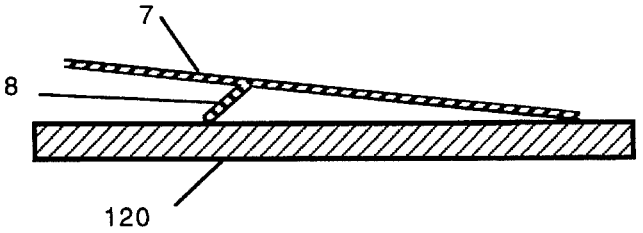
FIG. 10 is a side view of a typical spatula/plate with the thumb hole used as a support.

Each trapezoidal spatula/plate 7 has a thumb hole 8 cut into the large base portion as shown. The curved portions 9 of the thumb holes 8 are precut. The bases 10 of the thumb holes are perforated for ease of removal. Besides being used as thumb holes, the thumb holes 8 can also be used as a support for the spatula-plates 7, if desired. For this use, the thumb holes 8 are not removed but bent down perpendicular to the spatula/plate 7. This keeps the back of the spatula/plate 7 raised above the table 120, making it easier to grasp the end of the spatula/plate 7. FIG. 10 shows this use.

Figure 2:
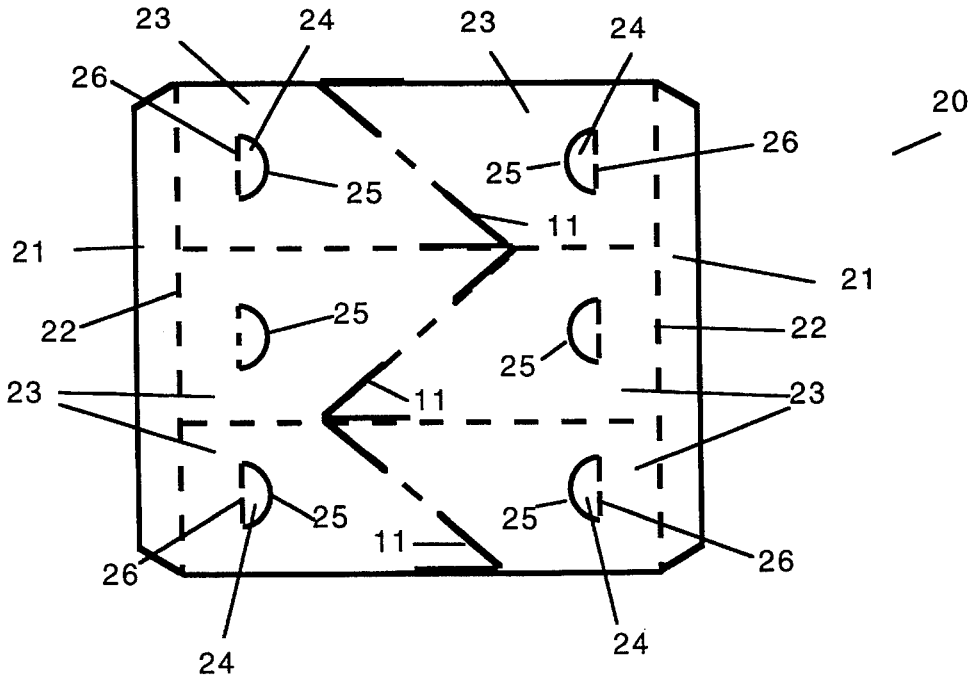
FIG. 2 is a top view of an insert for a large pizza box.

FIG. 2 shows a box insert 20. The insert 20 is used to provide a set of spatula-plates 23 in already existing pizza boxes. There are thousands of pizza boxes already in existence. The insert 20 allows people to continue to use these boxes while providing the spatula-plates 23 to customers. The insert 20 has two removable end flaps 21. The end flaps 21 are perforated at their inside edges 22 as shown. This permits the end flaps 21 to be removed from the insert 20 before use. The insert 20 for large pizza boxes has six spatula-plates 23 that are perforated as shown. These spatula-plates 23 are identical to those used in the large pizza box top 1 described above. The spatula-plates 23 are trapezoidal in shape. A thumb hole 24 is provided in each spatula/plate 23 as shown. As in the case above, the curved portions 25 of the thumb holes 24 are precut. The bases 26 of the thumb holes 24 are perforated for ease of removal.

Figure 3:
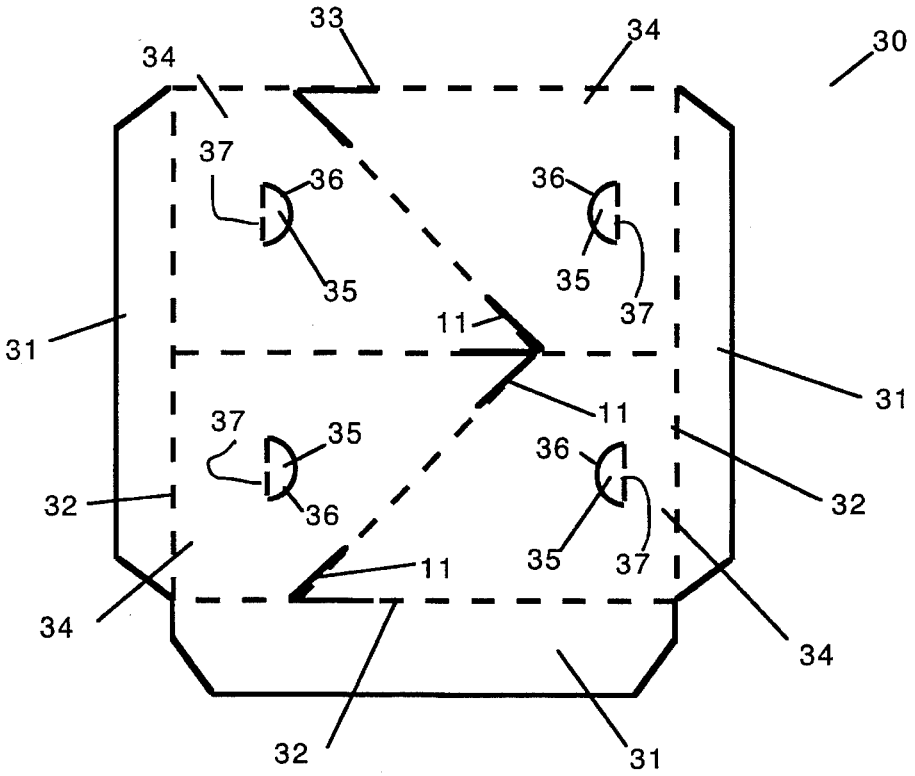
FIG. 3 is a top view of a medium pizza box showing the invention.
Figure 4:
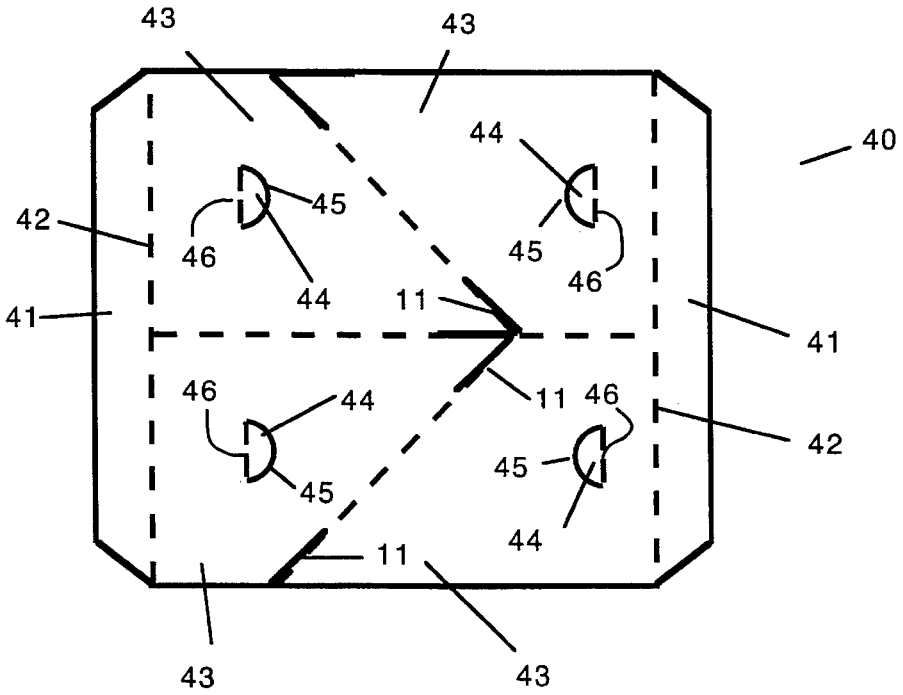
FIG. 4 is a top view of an insert for a medium pizza box.

Referring now to FIGS. 3 and 4, the box top 30 and insert 40 for a medium size pizza are shown. For the medium box top 30, (FIG. 3), three end flaps 31 are provided. As in the case of the large pizza box top 1, the end flaps 31 are perforated on their inner edges 32 as shown, for easy removal of the end flaps 31 from the box top 30. The bottom edge of the box top 33 is also perforated so that the box top 30 can be removed from the box. For the medium box top 30, four trapezoidal spatula-plates 34 are provided. Each spatula/plate 34 has a thumb hole 35 cut into the large base portion as shown. The curved portions 36 of the thumb holes 34 are precut. The bases 37 of the thumb holes 35 are perforated for ease of removal. The design for the typical medium pizza box top 30 has four spatula-plates 34.

FIG. 4, shows the box insert 40 for medium size pizza boxes. The insert 40 has two removable end flaps 41. The end flaps 41 are perforated at their inside edges 42 as shown. This permits the end flaps 41 to be removed from the insert 40 before use. The insert 40 for medium pizza boxes has four spatula-plates 43 that are perforated as shown. These spatula-plates 43 are identical to those used in the medium pizza boxes 30 described above. The spatula-plates 43 are trapezoidal in shape. A thumb hole 44 is provided in each spatula/plate 43 as shown. As in the case above, the curved portions 45 of the thumb holes 44 are precut. The bases 46 of the thumb holes 44 are perforated for ease of removal.

Figure 5:
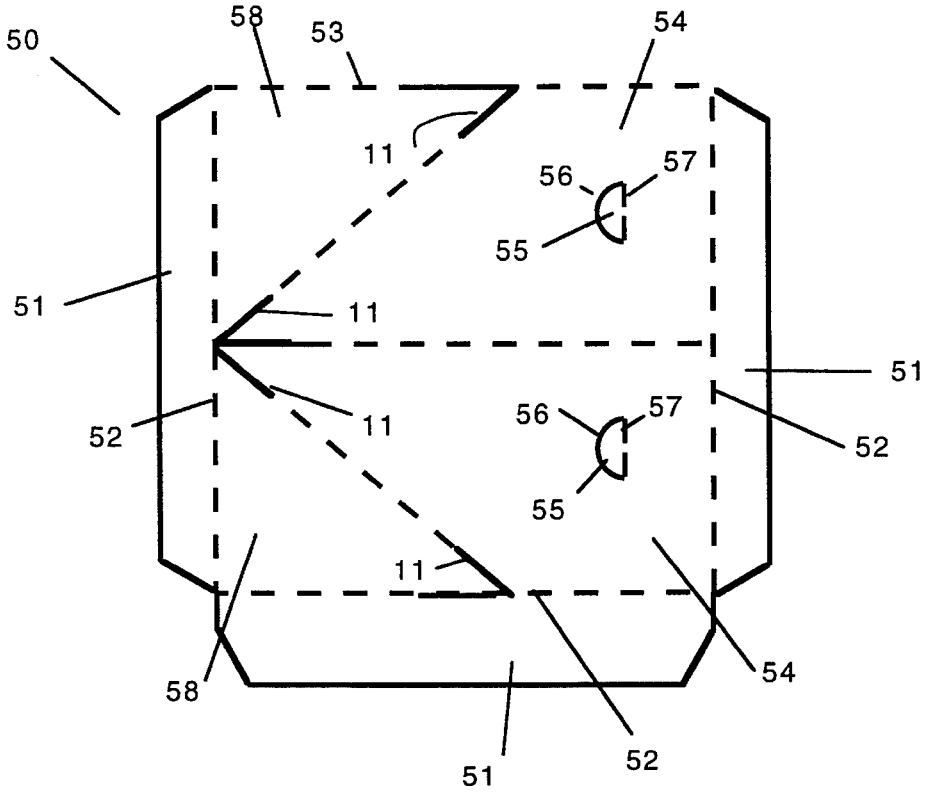
FIG. 5 is a top view of a small pizza box showing the invention.
Figure 6:
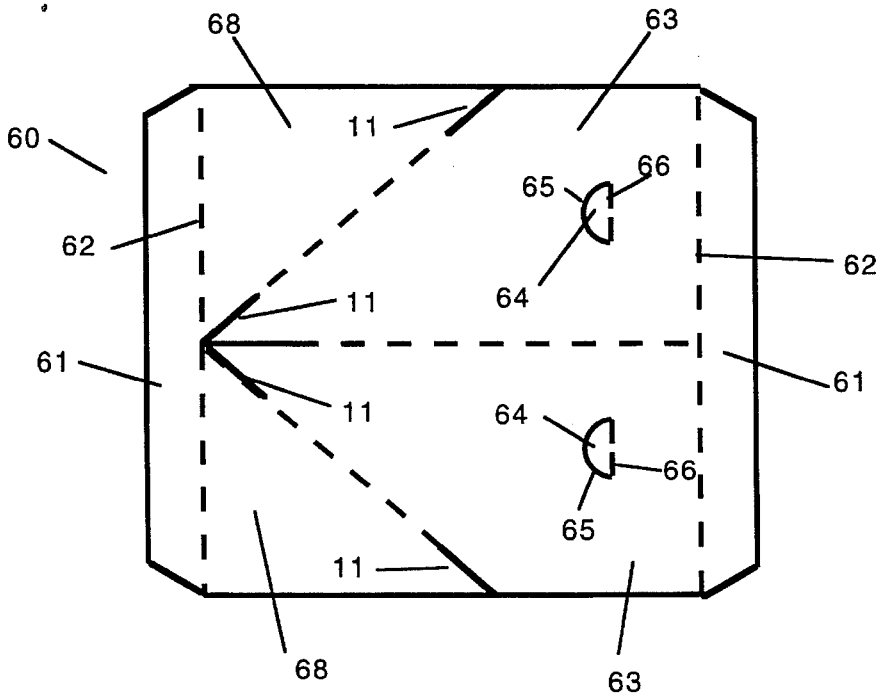
FIG. 6 is a top view of an insert for a small pizza box.

Referring now to FIGS. 5 and 6, the box top 50 and insert 60 for a small pizza boxes are shown. FIG. 5 shows the small box top 50. As in the case of the other box tops, three end flaps 51 are provided. The end flaps 51 are perforated on their inner edges 52 as shown, for easy removal of the end flaps 51. The bottom edge 53 of the box top 50 is also perforated so that the box top 50 can be removed from the box. For the small box design, two trapezoidal spatula-plates 54 are provided. Each trapezoidal spatula/plate 54 has a thumb hole 55 cut into the large base portion as shown. The curved portions 56 of the thumb holes 54 are precut. The bases 57 of the thumb holes are perforated for ease of removal. The design for the typical small pizza box has two spatula-plates 54. To fill in the space not used by the spatula-plates 54, two triangular spacer forms 58 are provided. These spacer forms 58 can be discarded after the spatula-plates 54 have been removed.

FIG. 4, shows the box insert 60 for small size pizza boxes. The inset 60 has two removable end flaps 61. The end flaps are perforated at their inside edges 62 as shown. This permits the end flaps 61 to be removed from the insert before use. The insert 60 for small pizza boxes has two spatula-plates 63 that are perforated as shown. These spatula-plates 63 are identical to those used in the small pizza boxes described above. The spatula-plates 63 are trapezoidal in shape. A thumb hole 64 is provided in each spatula/plate 63 as shown. As in the case above, the curved portions 65 of the thumb holes 64 are precut. The bases 66 of the thumb holes 64 are perforated for ease of removal. To fill in the space not used by the spatula-plates 63, two triangular spacer forms 68 are provided. These spacer forms 68 can be discarded after the spatula-plates 63 have been removed.

Figure 7:
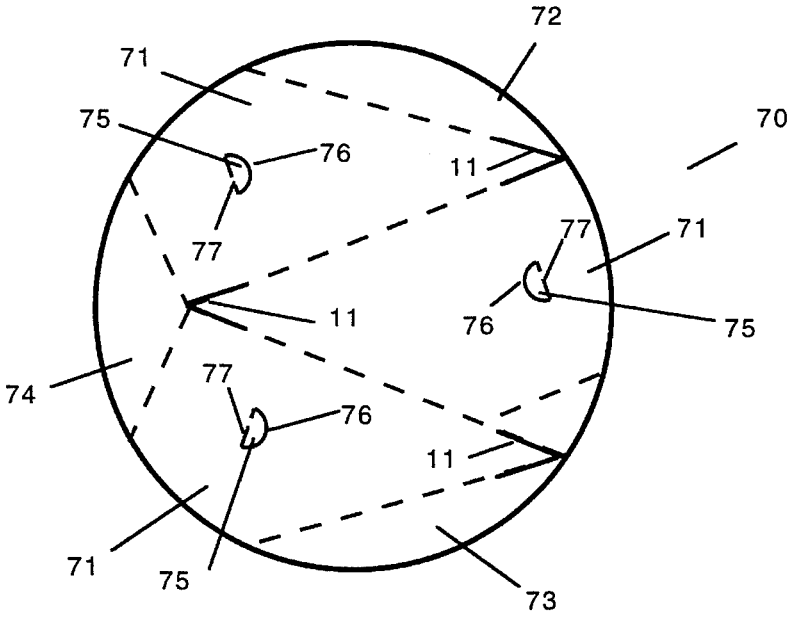
FIG. 7 is a top view of a base for supermarket type shrink-wrapped type pizzas.

Referring now to FIG. 7, a circular base plate 70 is shown. This base plate 70 is designed to be used with supermarket style pizzas. These pizzas are typically sold by placing unbaked pizzas on a circular cardboard base. The pizza is then covered with shrink-wrap plastic to seal the pizza. The instant invention uses the circular base plate 70 instead of the usual cardboard base in use today.

The circular base plate 70 shown has three trapezoidal spatula-plates 71 as shown. The spatula-plates 71 are perforated for easy removal. Filler segments 72, 73 and 74 are provided to fill the space around the spatula-plates 71. A thumb hole 75 is provided in each spatula/plate 71 as shown. As in the case above, the curved portions 76 of the thumb holes 75 are precut. The bases 77 of the thumb holes 75 are perforated for ease of removal.

Finally, the spatula-plates can be kept after the first use to be used for reheating pizza in microwave ovens. The spatula-plates have two advantages over ordinary dishes. First, they eliminate the need to clean the dish after use. Second, the cardboard material provides excellent insulation to speed up the reheating process.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A box for carrying food products comprising:

a) a bottom portion; and b) a top portion, said top portion being removably attached to said bottom portion, said top portion also having a plurality of trapezoidal spatula/plate portions removably formed therein.

2. The box for carrying food products of claim 1 wherein said plurality of trapezoidal spatula/plate portions have thumb holes formed therein.

3. The box for carrying food products of claim 1 wherein the number of trapezoidal spatula/plate portions is six.

4. The box for carrying food products of claim 1 wherein the number of trapezoidal spatula/plate portions is four.

5. The box for carrying food products of claim 1 wherein the number of trapezoidal spatula/plate portions is two.

6. The box for carrying food products of claim 1 wherein said top portion further comprises at least one end flap portion removably attached to said top portion.

7. The box for carrying food products of claim 1 wherein said box is square.

8. The box for carrying food products of claim 1 wherein said top portion is round.

9. The box for carrying food products of claim 8 wherein the number of trapezoidal plate portions is three.

10. The box for carrying food products of claim 8 wherein said plurality of trapezoidal spatula/plate portions have thumb holes formed therein.

11. A removable insert for placement in conventional pizza boxes comprising:

a) a formed portion being sized to fit within said conventional pizza boxes and having a plurality of trapezoidal spatula/plate portions removably formed therein.

12. The removable insert for placement in conventional pizza boxes of claim 11 wherein said plurality of trapezoidal spatula/plate portions have thumb holes formed therein.

13. The removable insert for placement in conventional pizza boxes of claim 11 wherein the number of trapezoidal plate portions is six.

14. The removable insert for placement in conventional pizza boxes of claim 11 wherein the number of trapezoidal plate portions is four.

15. The removable insert for placement in conventional pizza boxes of claim 11 wherein the number of trapezoidal plate portions is two.

16. The removable insert for placement in conventional pizza boxes of claim 11 wherein said removable insert for placement in conventional pizza boxes further comprises at least one end flap portion removably attached to said removable insert.

* * * * *